US008087828B2

(12) United States Patent
Noguchi et al.

(10) Patent No.: US 8,087,828 B2
(45) Date of Patent: Jan. 3, 2012

(54) SYNTHETIC RESIN BAG HAVING AN EASY OPENING FUNCTION

(76) Inventors: Takayuki Noguchi, Shizuoka (JP); Toshiyuki Murofushi, Shizuoka (JP)

( * ) Notice: Subject to any disclaimer, the term of this patent is extended or adjusted under 35 U.S.C. 154(b) by 301 days.

(21) Appl. No.: 12/517,246

(22) PCT Filed: Dec. 6, 2007

(86) PCT No.: PCT/JP2007/073585

§ 371 (c)(1),
(2), (4) Date: Jun. 2, 2009

(87) PCT Pub. No.: WO2008/069270

PCT Pub. Date: Jun. 12, 2008

(65) Prior Publication Data

US 2009/0304311 A1 Dec. 10, 2009

(30) Foreign Application Priority Data

Dec. 8, 2006 (JP) ..... 2006-331400

(51) Int. Cl.
*B65D 33/00* (2006.01)
*B65D 33/16* (2006.01)

(52) U.S. Cl. ..... 383/211; 383/210.1; 383/61.2

(58) Field of Classification Search ..... 383/210–211, 383/63, 61.2
See application file for complete search history.

(56) References Cited

U.S. PATENT DOCUMENTS 4,844,759 A * 7/1989 Boeckmann ..... 156/66
4,915,289 A * 4/1990 Hatano et al. ..... 229/123.1
5,330,269 A * 7/1994 Kamada et al. ..... 383/210
6,183,134 B1 * 2/2001 Malin ..... 383/210
6,290,393 B1 * 9/2001 Tomic ..... 383/210.1
7,207,718 B2 * 4/2007 Machacek ..... 383/61.2
7,213,305 B2 * 5/2007 Stolmeier et al. ..... 24/389
7,249,887 B2 * 7/2007 Kinigakis et al. ..... 383/61.2
2005/0041888 A1 * 2/2005 Matsuzawa et al. ..... 383/9

FOREIGN PATENT DOCUMENTS

JP 57-96952 A 6/1982

(Continued)

*Primary Examiner* — Jes F Pascua

(74) *Attorney, Agent, or Firm* — Pearne & Gordon LLP

(57) ABSTRACT

There is provided a synthetic resin bag having an easy-opening function in which an opening operation can be easily made on a side of an opening section of a bag body while it is prevented on a side of an interior section of the bag body and comprising two front and back panel films 1*a* and 1*b* of the bag body and two easy peel tapes 4*a* and 4*b* each including an easy peel layer and a thermally adhesive layer and disposed inside of the panel films of the bag body in an opening section 2 thereof over the whole lateral widths thereof, the easy peel layers of the two easy peel tapes faced to each other being weakly adhered to each other as indicated by a reference numeral 6 and the thermally adhesive layers of the two easy peel tapes being strongly adhered as indicated by reference numerals 5*a* and 5*b* to the inner faces of the panel films 1*a* and 1*b* of the bag body, respectively, so that the thermally adhesive layers have adhesion width difference of long and short widths C1 and C2 in a direction perpendicular to the lateral width of the bag body whereby the easy peel tapes can be easily separated on the side of the opening section 2 of the bag body while the easy peel tapes can be prevented from being separated on the side of the interior section of the bag body.

8 Claims, 12 Drawing Sheets

FOREIGN PATENT DOCUMENTS

| | | | | |
|---|---|---|---|---|
| JP | 57-105248 | A | | 6/1982 |
| JP | 62-38920 | B | | 10/1987 |
| JP | 62-271847 | A | | 11/1987 |
| JP | 2-242748 | A | | 9/1990 |
| JP | 04057750 | A | * | 2/1992 |
| JP | 06-10151 | A | | 2/1994 |
| JP | 6-14044 | A | | 2/1994 |
| JP | 2003137314 | A | * | 5/2003 |
| JP | 2005281599 | A | * | 10/2005 |
| JP | 2006-26476 | A | | 10/2006 |

* cited by examiner

SYNTHETIC RESIN BAG HAVING AN EASY OPENING FUNCTION

TECHNICAL FIELD

This invention relates to a synthetic resin bag having an easy-opening function.

BACKGROUND OF THE INVENTION

There has been provided a synthetic resin bag having a freely closable zipper provided in an opening section of the bag body and an easy peel tape provided below the zipper.

It is a purpose of arrangement of the easy peel tape that an air-tight state is maintained within the bag body even though the zipper is opened and also that a liquid content contained within the bag body can be prevented from exuding out of the bag body.

However, closure means in the form of the easy peel tapes has an exudation prevention function of the fluid from the bag body to the exterior by a glue layer having a powerful adhesive strength, but it has a problem that the easy peel tape cannot be easily peeled off on the side of the opening section of the bag body.

Easily peeling off the tape from the opening section side can be accomplished by setting the adhesive intensity at 0.6 through 1.5 kg/15 mm, but this intensity is insufficient against a pressure from the bag interior section and therefore the kind, the weight, the filling rate etc. of the contents will be limited. In order to cancel such a default, the adhesive intensity of the easy peel tapes is required to be set at 2.0 through 4.0 kg/15 mm or more, but it will remain the problem that the peeling on the opening section side of the bag body is not easy.

Patent documents 1 JP,57-96952 A
Patent documents 2 JU57-105248A
Patent documents 3 JU62-38920Y
Patent documents 4 JP62-271847A
Patent documents 5 JP2-242748A
Patent documents 6 JU 6-14044A

DISCLOSURE OF THE INVENTION

Problem to be Solved by the Invention

This invention is to provide a synthetic resin bag having an easy-opening function wherein it can be easily opened on the side of the opening section and also it can be prevented from being peeled off on the interior section.

Means to Solve the Problem

In order to solve the aforementioned problem, there is provided in a first form of embodiment of the invention a synthetic resin bag having an easy-opening function characterized by comprising two easy peel tapes each including an easy peel layer and a thermally adhesive layer and disposed inside of panel films of a bag body on an opening section thereof over the whole lateral widths of the panel films, said easy peel layers of said two easy peel tapes faced to each other being weakly adhered to each other and said thermally adhesive layers of said easy peel tapes being strongly adhered to the inner faces of said panel films of said bag body, respectively in a direction perpendicular to the lateral width of said bag body so that said thermally adhesive layers have adhesion width difference of long and short widths whereby said easy peel tapes can be easily separated on the side of said opening section of said bag body while said easy peel tapes can be prevented from being peeled off on the interior section of said bag body.

In a second form of embodiment of the invention, there is provided a synthetic resin bag having an easy-opening function, said synthetic resin bag comprising two front and back panel films characterized by further comprising two easy peel tapes each including an easy peel layer and a thermally adhesive layer and disposed inside of panel films of a bag body in an opening section thereof over the whole lateral widths of the bag body, said easy peel layers of said two easy peel tapes faced to each other being weakly adhered to each other, said thermally adhesive layer of one of said easy peel tapes being strongly adhered to one of said panel films of said bag body over the whole tape width of said one easy peel tape in a direction perpendicular to the lateral bag width while said thermally adhesive layer of the other easy peel tape being strongly adhered to the other of said panel films of said bag body over the width narrower than said strong adhesion width of said thermally adhesive layer of said one easy peel tape so that said easy peel tapes have strong adhesion width difference and the bag opening section side edges of said strong adhesion are positioned at a location equal to the bag body opening section side edges of said easy peel tapes whereby said easy peel tapes can be easily opened on the side of said opening section of said bag body while said easy peel tapes can be prevented from being peeled off on the interior section of said bag body.

In a third form of embodiment of the invention, there is provided a synthetic resin bag having an easy-opening function, said synthetic resin bag comprising two front and back panel films of a bag body characterized by further comprising two easy peel tapes each including an easy peel layer and a thermally adhesive layer and disposed inside of said panel films of said bag body in an opening section thereof over the whole lateral widths of said panel films, said easy peel layers of said two easy peel tapes faced to each other being weakly adhered, both of said thermally adhesive layers of said easy peel tapes being strongly adhered to the inner faces of said panel films of said bag body in a direction perpendicular to the lateral width of said bag body with the opening section side edges of said thermally adhesive layers of said easy peel tapes positioned at a location equal to the bag body opening section side edges of said easy peel tapes, a lower end of strong adhesion portion of one of said easy peel tapes being slightly placed upwardly while said strong adhesion of the other easy peel tape has a width narrower than the strong adhesion width portion of said one easy peel tape and is placed upwardly relative to a lower edge of said other easy peel tape so that said two easy peel tapes have strong adhesion width difference whereby said easy peel tapes can be easily opened on the side of said opening section of said bag body while said easy peel tapes can be prevented from being peeled off on the interior section of said bag body.

In a fourth form of embodiment of the invention, there is provided a synthetic resin bag having an easy-opening function, said synthetic resin bag comprising two front and back panel films of a bag body characterized by further comprising two easy peel tapes each including an easy peel layer and a thermally adhesive layer and disposed inside of said panel films of said bag body in an opening section thereof over the whole lateral widths of said panel films, said easy peel layers of said two easy peel tapes faced to each other being weakly adhered to each other, said thermally adhesive layer of one of said easy peel tapes being strongly adhered to the inner face of one of said panel films of said bag body with the tape width perpendicular to the lateral width of said bag body in a position of the bag body interior section side edge of said thermally adhesive layer while said thermally adhesive layer of the other easy peel tapes being strongly adhered to the inner face of the other panel film of said bag body with the width narrower than the tape width so that said two easy peel tapes have strong adhesion difference and the bag body opening section side edges are positioned slightly below the bag body opening section side edges of said easy peel tapes whereby said easy peel tapes can be easily opened on the side of said opening section of said bag body while said easy peel tapes can be prevented from being peeled off on the interior section of said bag body.

In a fifth form of embodiment of the invention, there is provided a synthetic resin bag having an easy-opening function, said synthetic resin bag comprising two front and back panel films of a bag body characterized by further comprising two easy peel tapes each including an easy peel layer and a thermally adhesive layer and disposed inside of said panel films in the opening section of said bag body with the lateral width of said bag body, said easy peel layers of said two easy peel tapes faced to each other being weakly adhered to each other, said thermally adhesive layer of one of said two easy peel tapes being strongly adhered to one of said panel films of said bag body so as to be placed upwardly from the bag body interior section side edge of said easy peel tape in a direction perpendicular to the lateral width of said bag body while said thermally adhesive layer of the other easy peel tape being strongly adhered to the other panel film with the width narrower than the tape width in the bag body interior section side edge of said thermally adhesive layer of said other easy peel tapes so that said two easy peel tapes have different strong adhesion width distances and the bag body opening section side edges of both of said strong adhesions are placed slightly below the bag body opening section side edges of said easy peel tapes whereby said easy peel tapes can be easily opened on the side of said opening section of said bag body while said easy peel tapes can be prevented from being peeled off on the interior section of said bag body.

In a sixth form of embodiment of the invention, there is provided a synthetic resin bag having an easy-opening function, said synthetic resin bag comprising two front and back panel films of a bag body characterized by further comprising one easy peel tape including an easy peel layer and a thermally adhesive layer, said easy peel layer having a non-adhesive portion on the side of the opening section of the bag body and being weakly adhered to the inner face of one of said two panel films on the side of the interior section of the bag body along the edge of said easy peel tape and said thermally adhesive layer of said easy peel tape being strongly adhered to the inner faces of the other panel films of said bag body with the width narrower than the width of said weak adhesion while having non-adhesive portions on the side of the opening section of said bag body and on the side of the interior section of said bag body, respectively so that said weak adhesion and strong adhesion have different adhesion width distances whereby said easy peel tape can be easily separated on the side of said opening section of said bag body while said easy peel tape can be prevented from being peeled off on the interior section of said bag body.

In a synthetic resin bag having an easy-opening function according to either of the first through sixth form, a re-closable zipper may be disposed in the opening section of the bag body on the upward side or on the downward side of the easy peel tape or tapes.

Effect of the Invention

According to the invention, one or two easy peel tapes can be detached with weak power due to the weak adhesion of the easy peel layer on the opening section side of the bag body whereby the opening operation of the bag body can be easily made and the weak adhesion of the easy peel layer or layers is never detached by the pressure of the interior section of the bag body whereby the tight closure of the bag body can be assured.

BEST MODE FOR EMBODIFYING THE INVENTION

Figure 1:
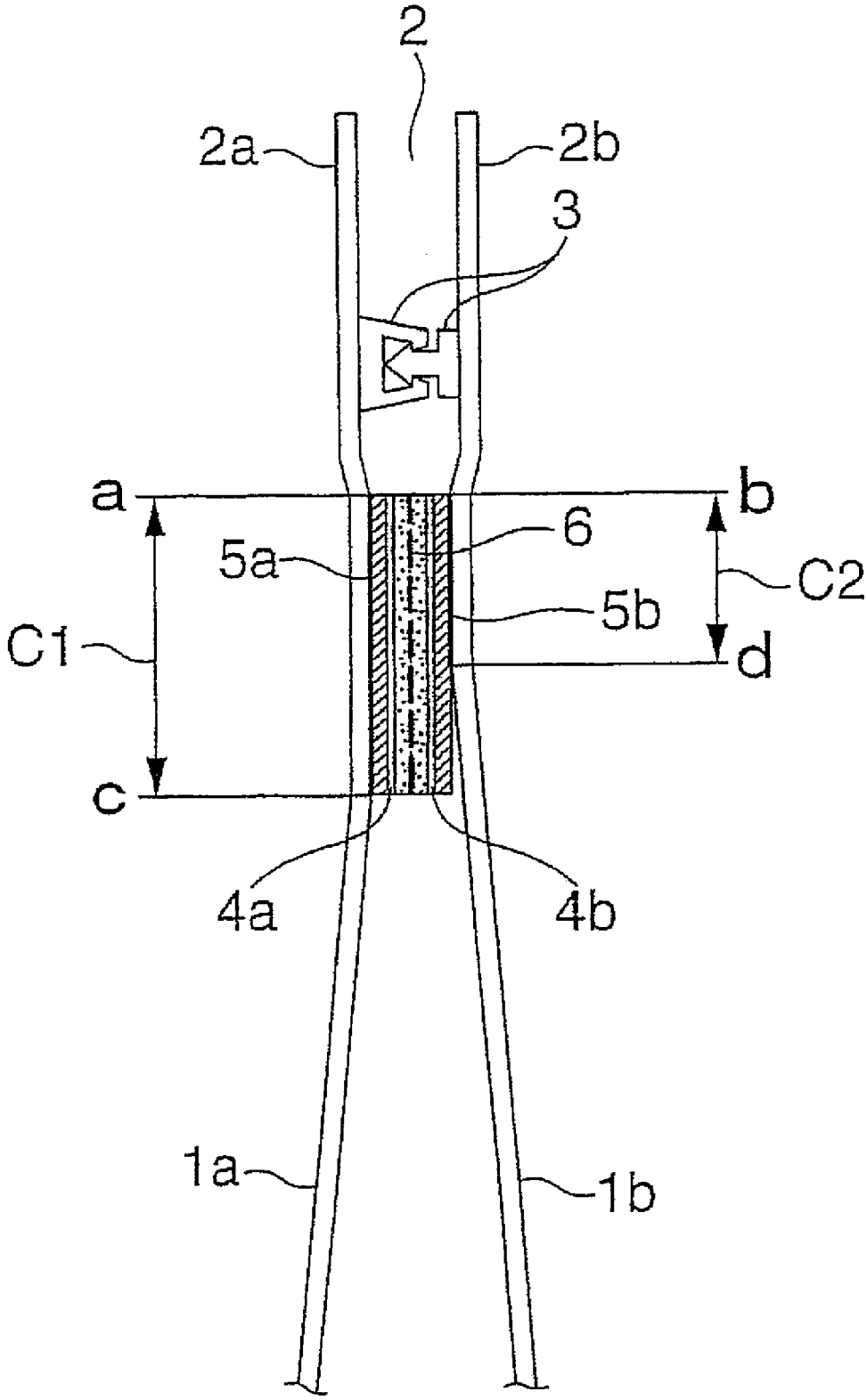
[FIG. 1] A sectional view of a feature of an embodiment 1 of the invention

The best mode for carrying out the invention will be described with reference to the drawings later. FIGS. 1 through 7 illustrate an embodiment 1 of the invention. A synthetic resin bag is formed of a front side panel film 1*a* and a back side panel film 1*b*. A reference numeral 2 designates an opening section of a bag body, a reference numeral 3 designates a re-closable zipper provided in the opening section 2 of the bag body and reference numerals 2*a* and 2*b* designate grasping pieces used for the opening operation of the opening section 2. These grasping pieces 2*a* and 2*b* may be upper ends of the panel films 1*a* and 1*b* or may be of peculiar members separated from the panel films 1*a* and 1*b*.

The synthetic resin bag 1 may comprise two easy peel tapes 4*a* and 4*b* disposed over the whole lateral width of the bag body and each having an easy peel layer 11 of weak adhesion face 6 faced to each other. The easy peel tapes 4*a* and 4*b* are strongly adhered to each other as indicated by reference numerals 5*a* and 5*b*. The strong adhesions 5*a* and 5*b* of both of the easy peel tapes 4*a* and 4*b* have an adhesion width difference of long width and short width. In FIGS. 1 through 4, the opening section side edges a and b of the strong adhesions 5*a* and 5*b* are positioned in the opening section side edges of the easy peel tapes 4*a* and 4*b*.

Figure 4:
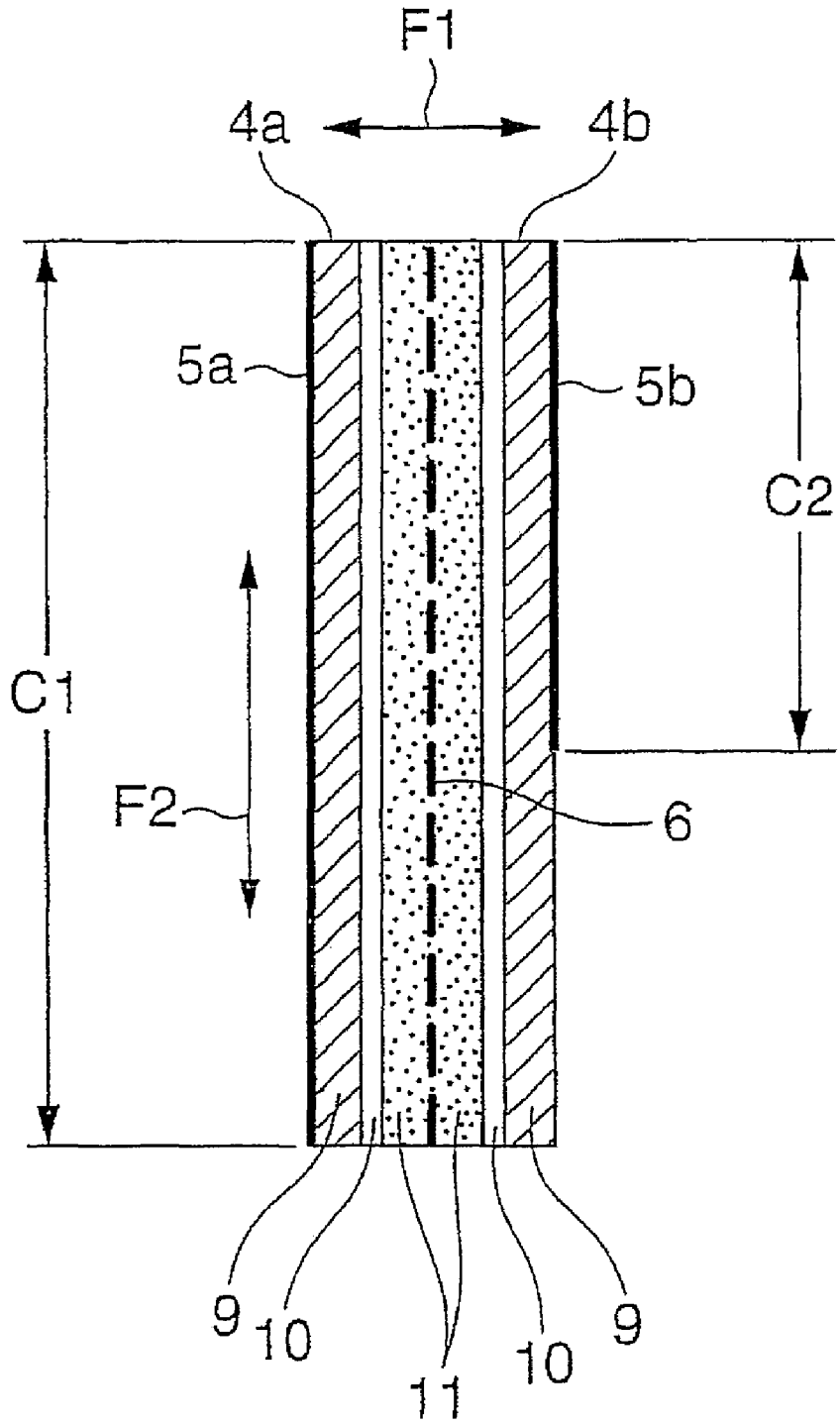
[FIG. 4] A sectional view of easy peel tapes of the embodiment 1.

As illustrated in FIG. 4, the easy peel tapes 4*a* and 4*b* each include three layers of a thermally adhesive layer 9 of PE, CPP, PET or NY, a middle layer 10 of PET or NY and an easy peel layer 11. The easy peel tapes are not limited to the three layer construction and they may be of two layer construction of the thermally adhesive layer 9 and the easy peel layer 11.

The embodiment 1 of the invention will be described with reference to FIG. 1. The easy peel tapes 4*a* and 4*b* are disposed inside of the panel films 1*a* and 1*b* on the side of the opening section 2 of the bag body with the easy peel layers 11 of weak adhesion 6 faced to each other over the whole lateral width of the bag. The easy peel tape 4*a*, one of the easy peel tapes 4*a* and 4*b* is strongly adhered as indicated by a reference numeral 5*a* to the inner face of the panel film 1*a* over the whole faces C1 of the tape width perpendicular to the whole width of the bag body. The other easy peel tape 4*b* is strongly adhered to the panel film 1*b* over the width C2 narrower than tape width in the bag body opening section side end of thereof. In other words, the strong adhesions 5*a* and 5*b* have such a relation that the strong adhesion 5*a*, one of the strong adhesions 5*a* and 5*b* has the whole tape width C1 and the other strong adhesion 5*b* has the width C2 narrower than the tape width. In addition thereto, they have such a construction that the opening section side ends a and b of the strong adhesions 5*a* and 5*b* are positioned at the opening section side edges of the easy peel tapes 4*a* and 4*b*. Thus, the bag body interior section side end c of the strong adhesion 5*a* and the bag body interior section side end d of the strong adhesion 5*b* having the width narrower than the tape width have the adhesion width difference of long and short widths. The width C2 narrower than the tape width may be properly approximately half of the tape width.

The adhesive strength of the weak adhesion face 6 may be 0.6 to 1.5 kg/15 mm while the adhesive strength of the strong adhesions 5*a* and 5*b* may be 2.0 to 4.0 kg/15 mm.

Figure 2:
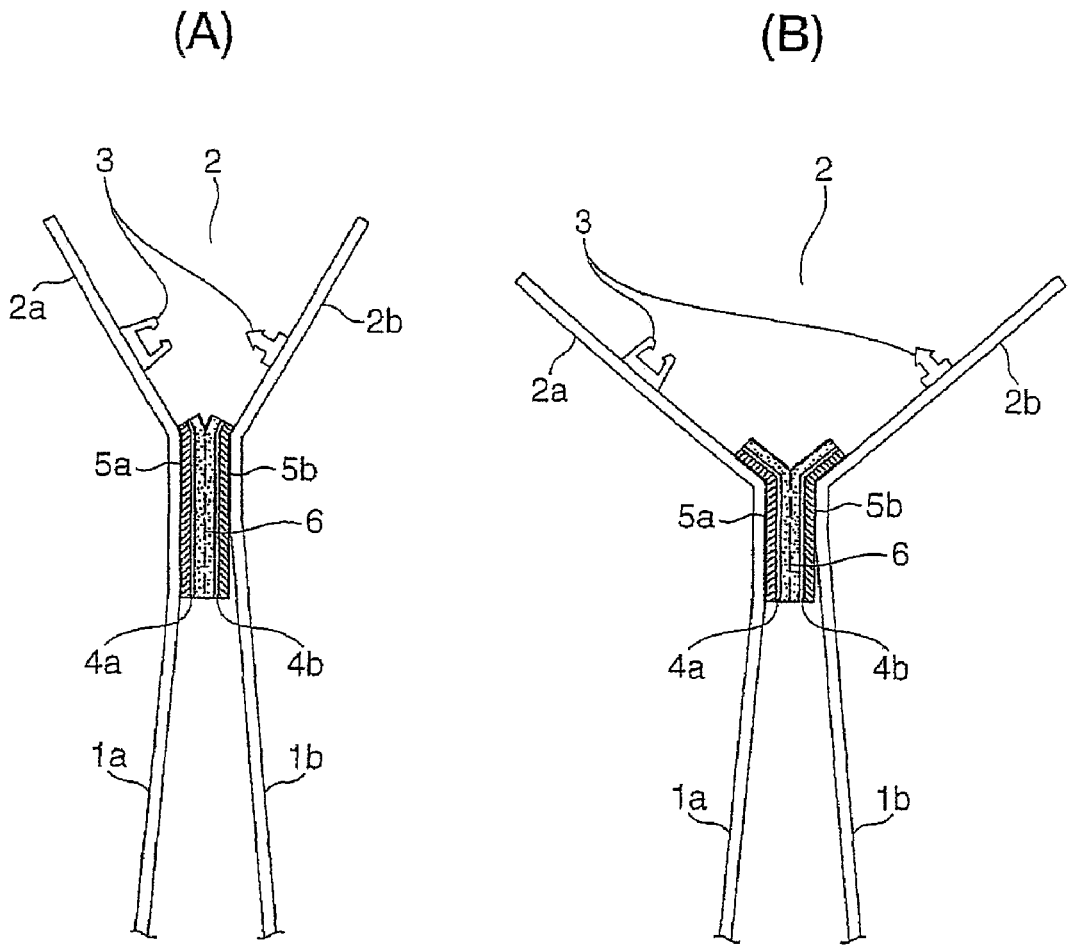
[FIG. 2] A sectional view of a feature of an open state of a bag body of the embodiment 1.

An operation of the embodiment 1 of the invention which has the aforementioned construction will be explained. When the opening section 2 should be opened, a user grasps the grasping pieces 2*a* and 2*b* by its fingertips and pulls them in leftward and rightward directions as shown in FIG. 2(A). The leftward and rightward pulling tension acts on the opening section side edges a and b of the easy peel tapes 4*a* and 4*b*, as shown in FIG. 2(B) whereby the opening section side edges of the easy peel tapes 4*a* and 4*b* are separated in leftward and rightward directions. Due to the leftward and rightward pulling tension acting on the opening section side edges a and b of the easy peel tapes 4*a* and 4*b*, a force F1 in leftward and rightward directions opposite to each other and perpendicular to the weak adhesion face 6 acts on the weak adhesion face 6 as shown in FIG. 4 whereby the weak adhesion face 6 starts to be separated in the leftward and rightward directions from the opening section side edges of the easy peel tapes 4*a* and 4*b* as shown in FIG. 2 and thereafter the whole weak adhesion face 6 is separated by the weak force. In other words, the easy peel tapes 4*a* and 4*b* can be separated by the weak force on the side of the opening section to thereby easily open the opening section 2 while their separation on the side of the bag body interior section can be prevented.

The reason why the easy peel tapes 4*a* and 4*b* can be separated by the weak force from the opening section side is that the force F1 in the leftward and rightward directions opposite to each other and perpendicular to the weak adhesion face 6 acts on the weak adhesion face 6 as shown in FIG. 4 by the leftward and rightward pulling force acting on the opening section side edges a and b of the easy peel tapes 4*a* and 4*b*.

On the other hand, the weak adhesion face 6 of the easy peel layer 11 is never separated by the pressure from the bag body interior section whereby .a state of sealing the bag body is maintained. The reason is that the bag body interior section side end c of the strong adhesion 5*a* and the bag body interior section side end d of the strong adhesion 5*b* having the width C2 narrower than the tape width have the adhesion width difference of long and short widths.

Figure 3:
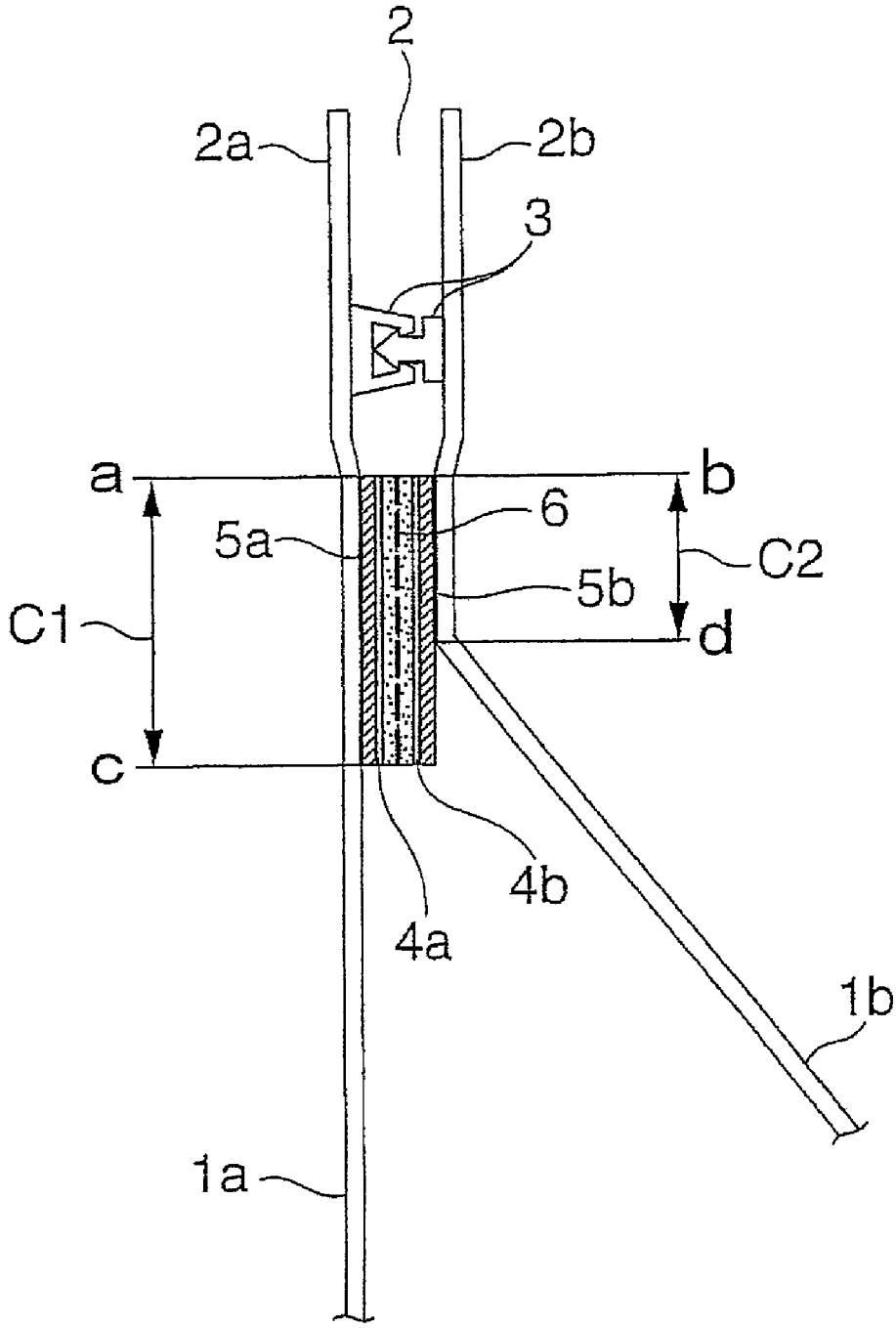
[FIG. 3] A sectional view of a feature of a state where a pressure is applied from an interior section of the bag body in the embodiment 1.

Namely, when the pressure is applied from the bag body interior section as shown in FIG. 3, a force acts on the bag body interior section side edge c of the strong adhesion 5*a* of the whole tape width surface C1 on the panel film 1*a* while a force acts on the bag body interior section side edge d of the strong adhesion 5*b* of the width C2 narrower than tape width on the panel film 1*b*. The forces applied to the bag body interior section side edge c of the strong adhesion 5*a* and the strong adhesion 5*b* having the adhesion width difference of long and short widths are forces F2 applied in the surface direction of the weak adhesion face 6. This force F2 of the surface direction of the weak adhesion face 6 never separates the weak adhesion face 6 of the easy peel layers 11 whereby the state of sealing the bag body is maintained.

Figure 5:
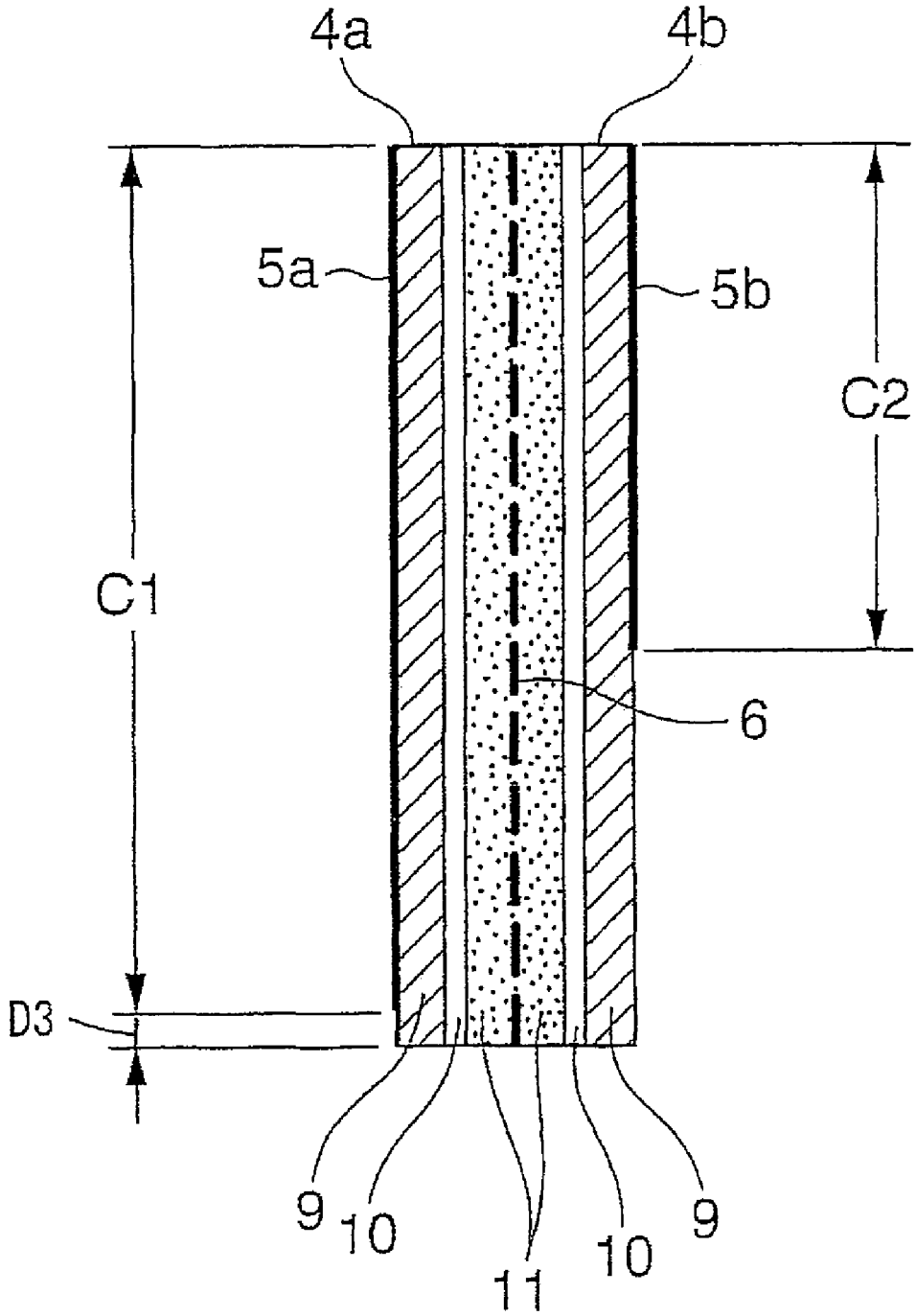
[FIG. 5] A sectional view of the easy peel tapes showing a modification of strong adhesion of the embodiment 1.

Next, an embodiment in which the design of the invention changes will be described later. As shown in FIG. 5, the opening section side edges of the strong adhesions 5*a* and 5*b* are positioned in the opening section side edges of the easy peel tapes 4*a* and 4*b* and the opening section side edge of the strong adhesion 5*a* on the side of the panel film 1*a* may be positioned in a location upwardly shifted by a distance D3 relative to the bag body interior section edge of the easy peel tape 4*a*.

Figure 6:
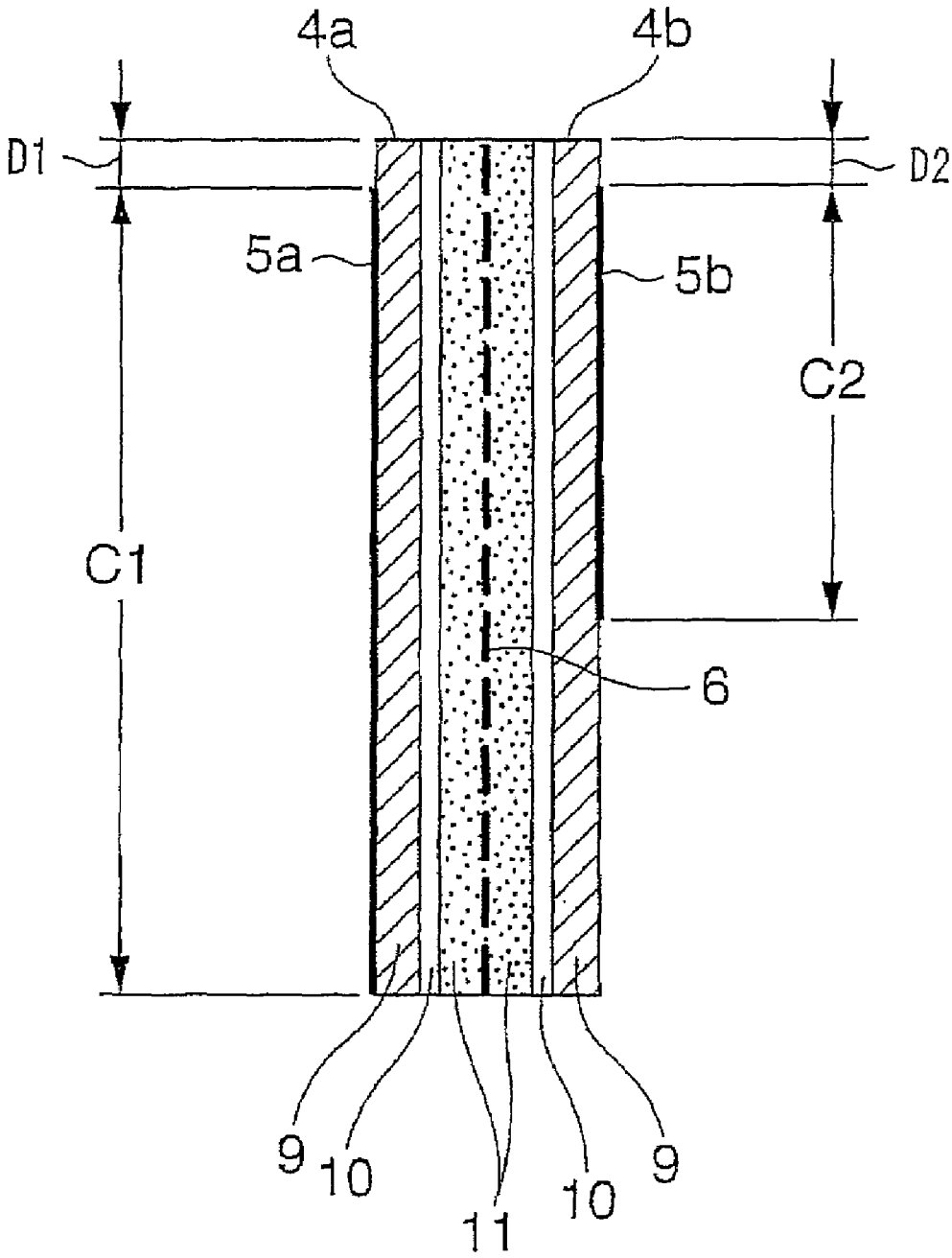
[FIG. 6] A sectional view of the easy peel tapes showing another modification of strong adhesion of the embodiment 1.

Otherwise, as shown in FIG. 6, the strong adhesion 5*a* may be made to the panel film 1*a* so that the bag body interior section side edge of the easy peel tape 4*a* is located at a lower edge of the tape width perpendicular to the bag lateral width direction while the strong adhesion 5*b* may be made to the panel film 1*b* so that the bag body interior section side end of the easy peel tape 4*b* has the width narrower than the tape width. The opening section side edges of the string adhesions 5*a* and 5*b* are positioned in a location downwardly and slightly shifted by distances D1 and D2 from the opening section side edges of the easy peel tape 4*a* and 4*b*. The distances D1 and D2 have such a relation of D1≧D2.

Figure 7:
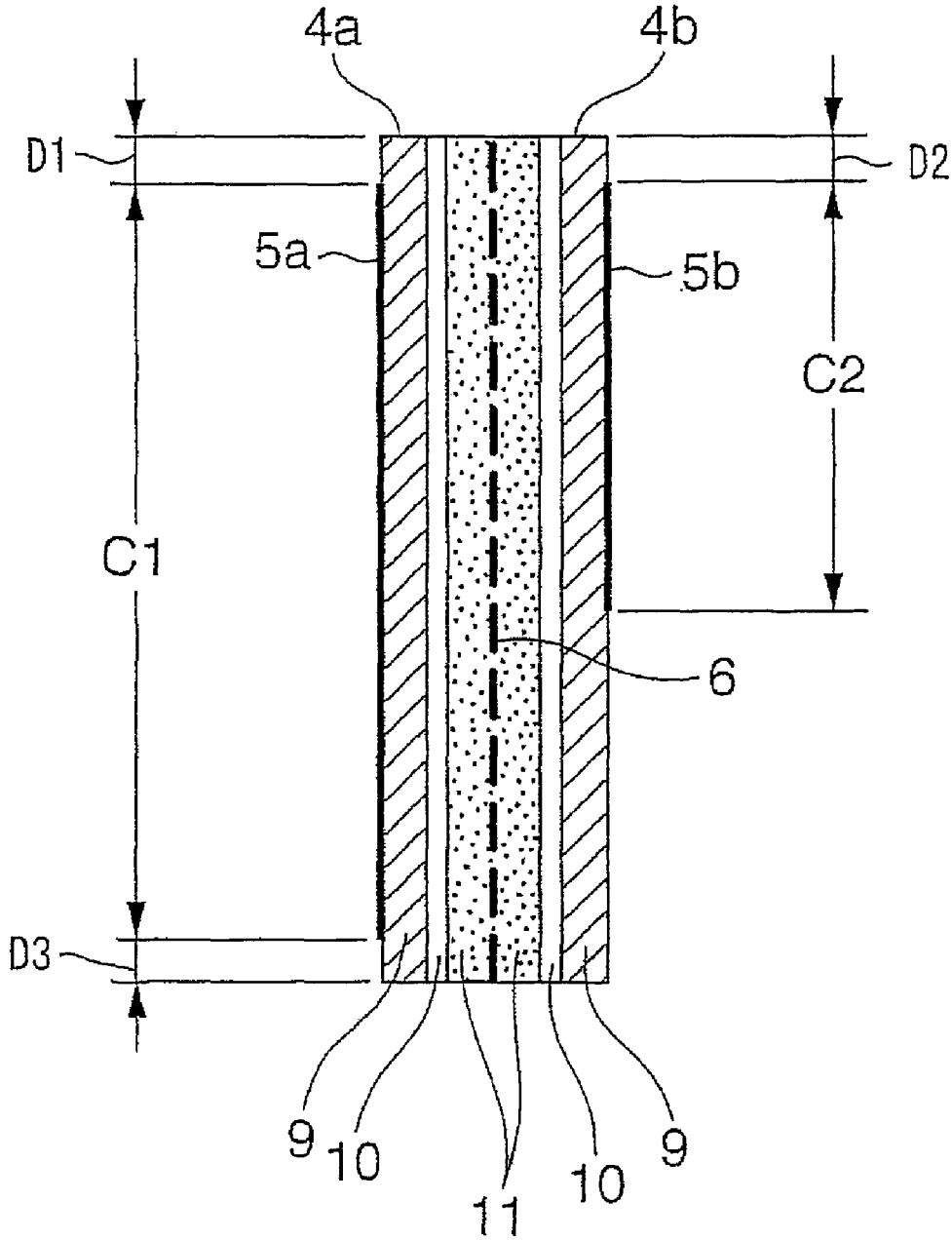
[FIG. 7] A sectional view of the easy peel tapes showing further modification of strong adhesion of the embodiment 1.

Otherwise, as shown in FIG. 7, the strong adhesion 5*a* of the easy peel tape 4*a* may be made to the panel film 1*a* so that it is positioned at a location upwardly and slightly shifted by the distance D3 from the bag body interior section side edge of the tape width perpendicular to the bag lateral width direction while the strong adhesion 5*b* of the easy peel tape 4*b* may be made to the panel film 1*b* so that the bag body interior section side end of the easy peel tape 4*b* has the width narrower than the tape width. The opening section side edges of the string adhesions 5*a* and 5*b* are positioned at a location downwardly and slightly shifted by distances D1 and D2 from the opening section side edges of the easy peel tape 4*a* and 4*b*. The distances D1 and D2 have such a relation of D1≧D2.

In either of the aforementioned change of the design, the easy peel tapes 4*a* and 4*b* can be separated by the weak force from the opening section side of the bag body to thereby easily open the opening section 2 while the prevention of the separation from the bag body interior section side can be made.

Thus, the embodiment 1 of the invention has such an advantage to maintain the form of the bag in which the aforementioned construction makes weaker the separating force for the easy peel tapes 4*a* and 4*b* on the opening section side of the bag body to thereby facilitate the opening operation and makes it difficult to separate the easy peel tapes 4*a* and 4*b* on the side of the bag body interior section of the bag body before the enclosure for goods should be opened. Furthermore, even if an unexpected force is applied to the bag from the outside, the force is never transmitted to the weak adhesion face 6 and is transmitted to the adhesion face through the strong adhesion 5*b* of the panel film 1*b* of the bag body interior section on the side of the width C2 narrower than the tape width to thereby maintain the adhesive strength and therefore the breakage of the bag can be advantageously prevented.

In the case where the goods content within the bag are liquid or water-like goods, since the easy peel tapes 4*a* and 4*b* are arranged below and along the lower portion of the zipper, the fluid etc. contained in the goods is prevented from exuding to the opening section 2 and therefore the bag has an advantage that an image of goods on their exhibition or treatment of goods is never damaged. Since the bag can be opened by separating the easy peel tapes 4*a* and 4*b* to take out the contents, a notch is not required, which tears the opening section to thereby take out the contents and the cut-off film pieces are not scattered.

Figure 8:
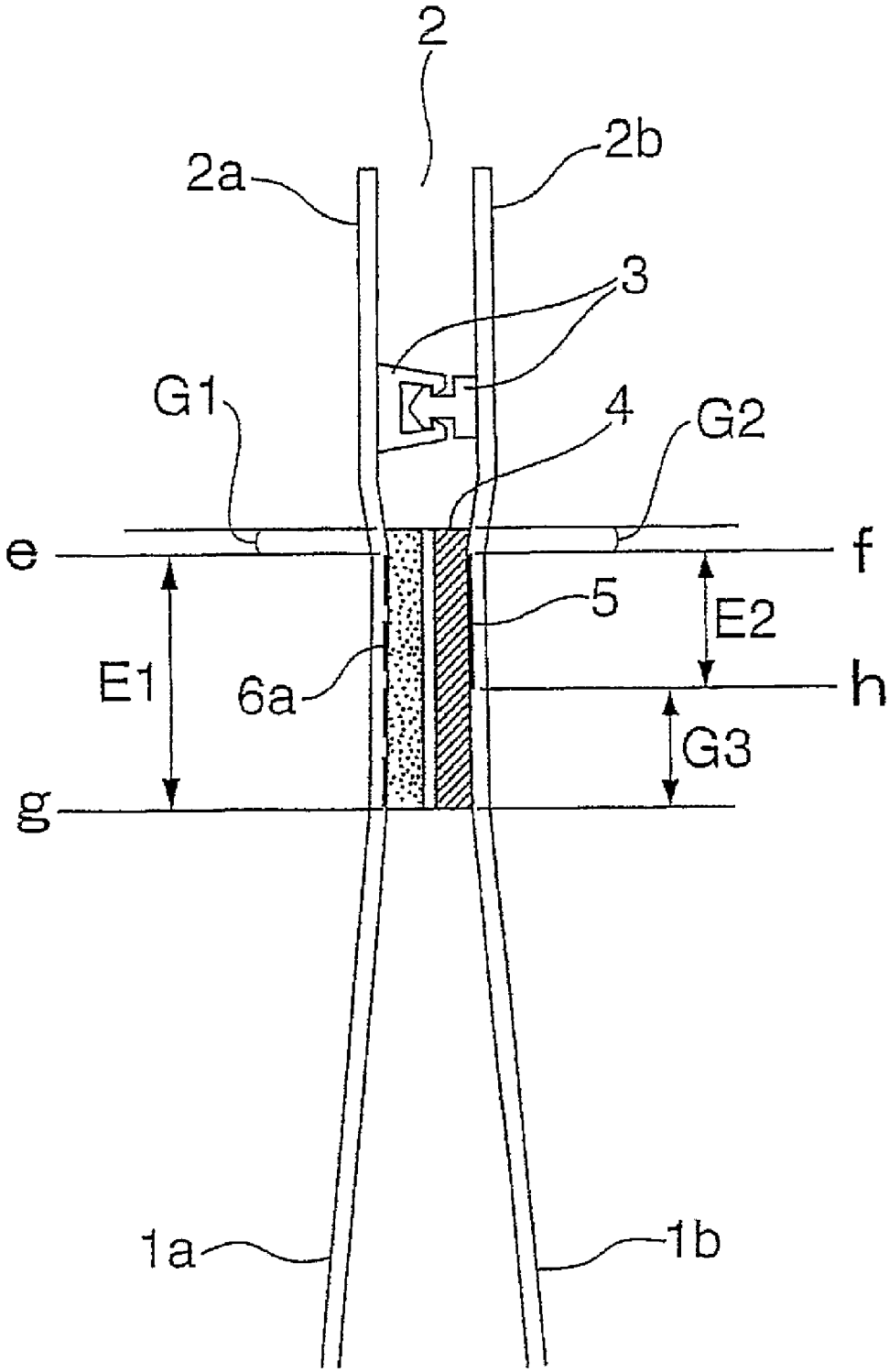
[FIG. 8] A sectional view of a feature of an embodiment 2 of the invention.
Figure 9:
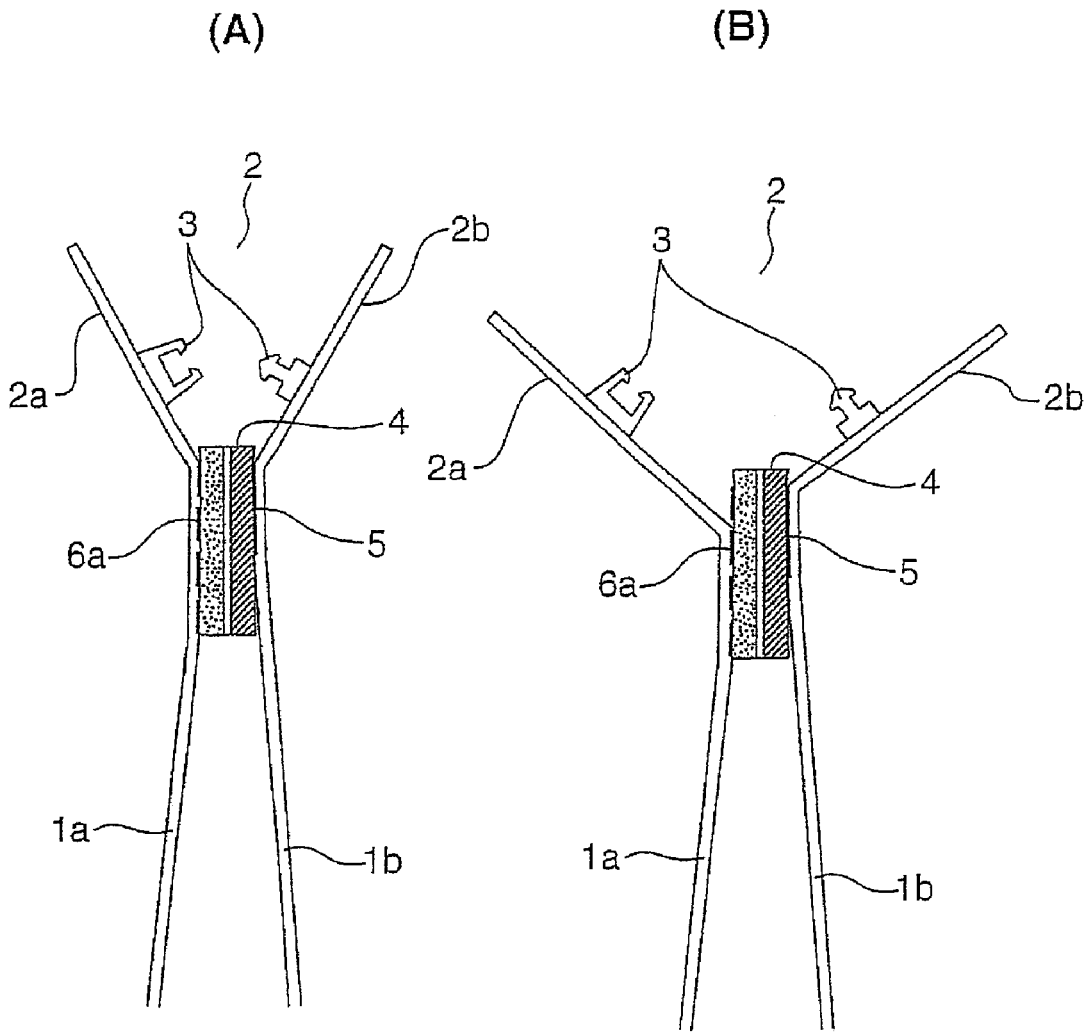
[FIG. 9] A sectional view of a feature of an open state of a bag body of the embodiment 2.
Figure 10:
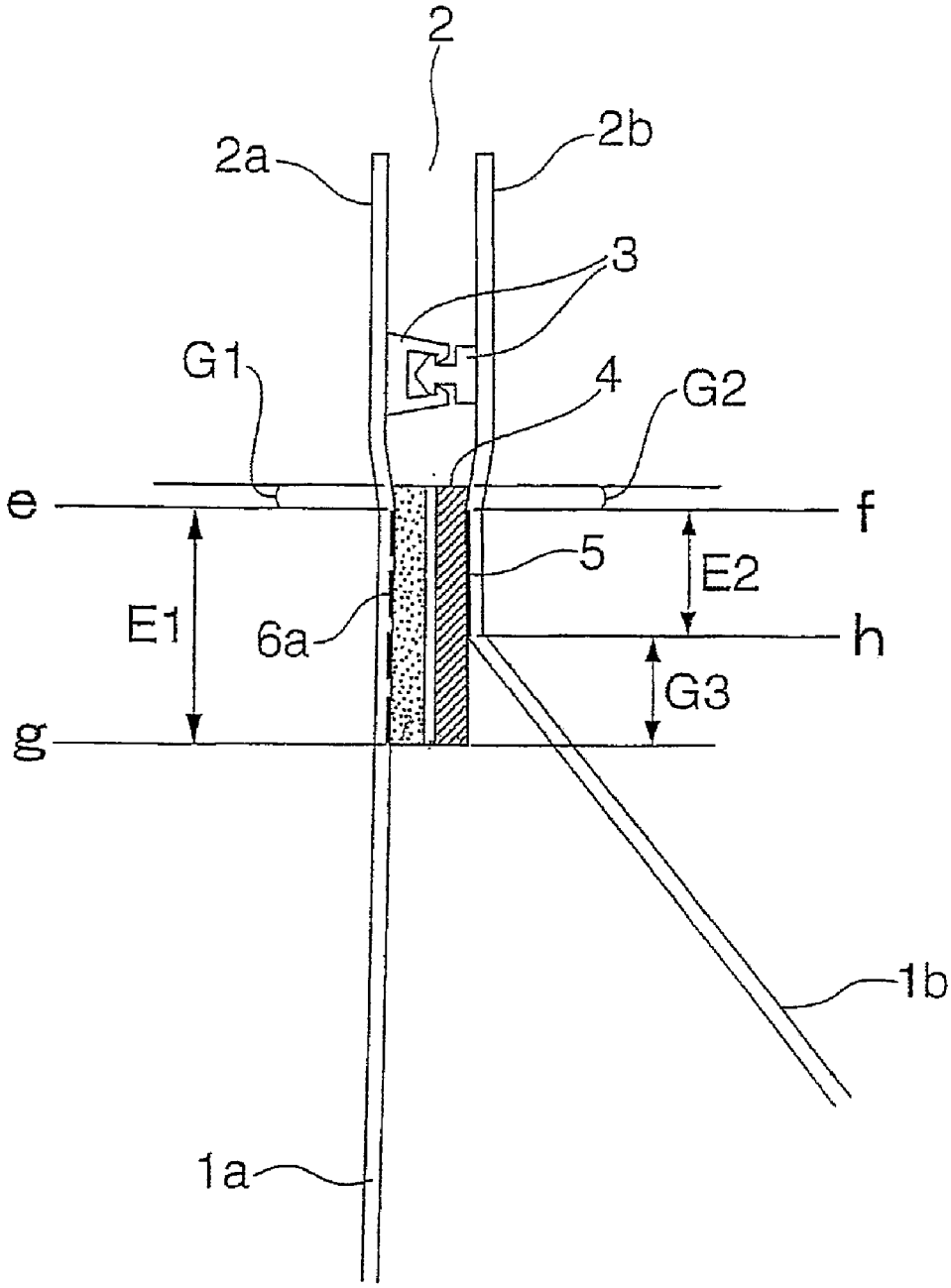
[FIG. 10] A sectional view of a feature of a state where a pressure is applied from an interior section of the bag body in the embodiment 2.

Although the aforementioned embodiment 1 relates to the synthetic resin bag comprising two easy peel tapes 4*a* and 4*b*, the invention may be applied also to the synthetic resin bag having one easy peel tape 4 as shown in FIGS. 8 through 10 in which the easy peel tape can be separated by the weak force from the opening section side due to by the weak adhesion of the easy peel layer to thereby facilitate the opening operation of the opening section of the bag body while the pressure from the bag body interior section cannot separate the weak adhesion of the easy peel layer to thereby maintain the state of sealing the bag body. The embodiment 2 according to one easy peel tape 4 will be described below.

Also in the embodiment 2, the synthetic resin bag is formed by the front panel film 1*a* and the back panel film 1*b*. A reference numeral 2 designates an opening section of a bag body, a reference numeral 3 designates a re-closable zipper provided in the opening section 2 of the bag body and reference numerals 2*a* and 2*b* designate grasping pieces used for the opening operation of the opening section 2. These grasping pieces 2*a* and 2*b* may be upper ends of the panel films 1*a* and 1*b* or may be of peculiar members separated from the panel films 1*a* and 1*b*.

Figure 11:
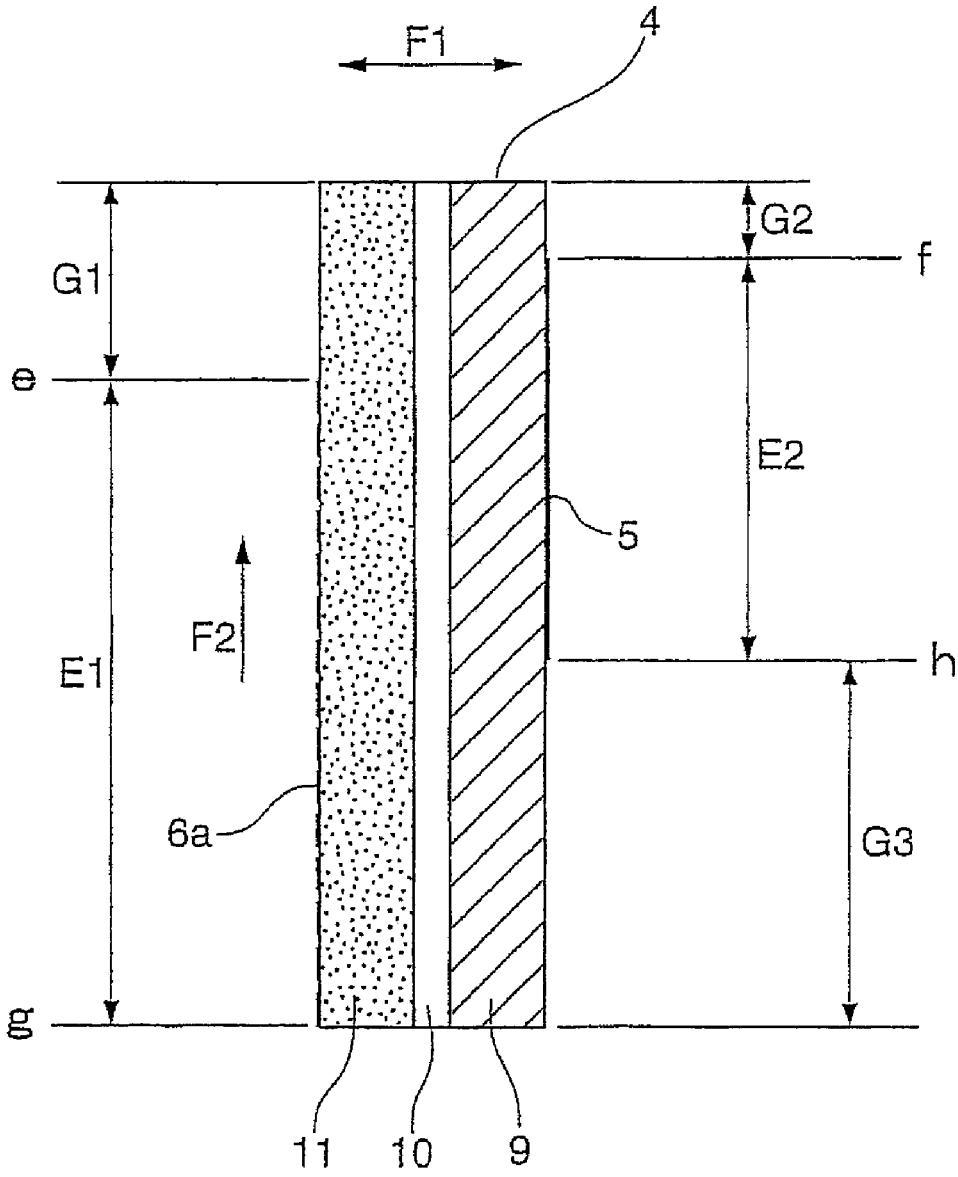
[FIG. 11] A sectional view of easy peel tapes of the embodiment 2.

As illustrated in FIG. 11, the easy peel tape 4 may be a tape which includes three layers of a thermally adhesive layer 9 of PE, CPP, PET or NY, a middle layer 10 of PET or NY and an easy peel layer 11. The easy peel tape is not limited to the three layer construction and it may be of two layer construction of the thermally adhesive layer 9 and the easy peel layer 11.

The easy peel tape 4 comprising the easy peel layer 11 and the thermally adhesive layer 9 has a non-adhesive portion G1 on the side of opening section 2 of the bag body where the easy peel layer 11 is not adhered to the inner face of the panel film 1*a* and is weakly adhered to the panel film 1*a* as indicated by a reference numeral 6*a* on the side of the interior section of the bag body with the adhesion width E1 along the edge of the easy peel tape 4. The thermally adhesive layer 9 of the easy peel tape 4 is strongly adhered to the inner face of the panel film 1*b* as indicated by a reference numeral 6*a* with the width E2 narrower than the adhesion width E1 of the weak adhesion 6*a* so that it has non-adhesion portions G2 and G3 on the sides of the bag body opening section 2 and the bag body interior section whereby the weak adhesion 6*a* and the strong adhesion 5 have the adhesion width difference of long and short widths in the tape width direction perpendicular to the lateral width of the bag.

The adhesive strength of the weak adhesion face 6*a* may be 0.6 to 1.5 kg/15 mm while the adhesive strength of the strong adhesions 5 may be 2.0 to 4.0 kg/15 mm.

An operation of the embodiment 2 of the invention which has the aforementioned construction will be explained. When the opening section 2 should be opened, a user grasps the grasping pieces 2*a* and 2*b* by its fingertips and pulls them in leftward and rightward directions as shown in FIG. 9(A). The leftward and rightward pulling tension acts on the portions e and f of the easy peel tape 4 located below the opening section side edge of the easy peel tape 4 by the distances of the non-adhesive portions G1 and G2, as shown in FIG. 9(B) whereby the opening section side edge of the easy peel tape 4 is easily separated in leftward and rightward directions. Due to the leftward and rightward pulling tension acting on the portions e and f of the easy peel tape 4 located below the opening section side edge of the easy peel tape 4 by the distances of the non-adhesive portions G1 and G2, a force F1 in leftward and rightward directions opposite to each other and perpendicular to the weak adhesion face 6*a* acts on the weak adhesion face 6*a* as shown in FIG. 11 whereby the weak adhesion face 6*a* starts to be separated in the leftward and rightward directions from the opening section side edge of the easy peel tape 4 as shown in FIG. 9 and thereafter the whole weak adhesion face 6*a* is separated by the weak force. In other words, the easy peel tape 4 can be separated by the weak force on the opening section side of the bag body to thereby easily open the opening section 2 while its separation on the side of the bag body interior section is prevented.

Figure 12:
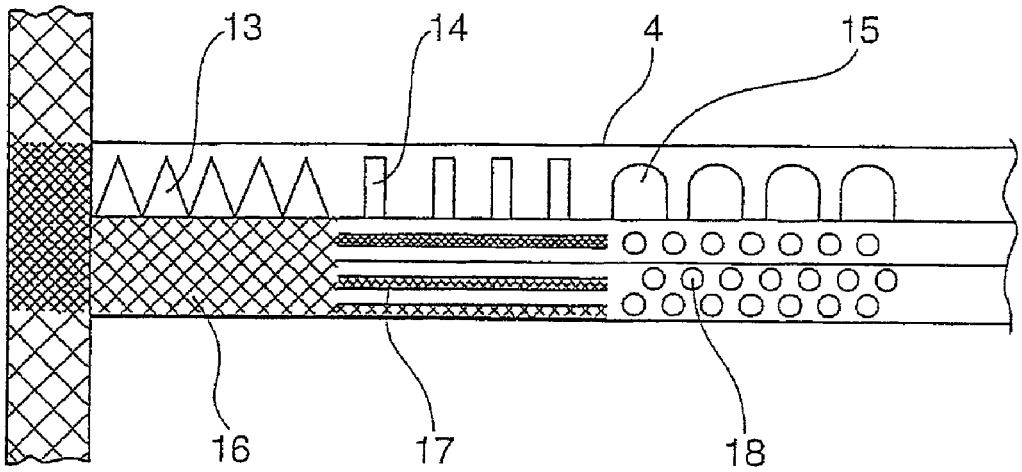
[FIG. 12] A view showing various adhesion patterns of weak adhesion in the easy peel tapes.

The reason why the easy peel tape 4 can be separated by the weak force on the opening section side is that the force F1 in the leftward and rightward directions opposite to each other and perpendicular to the weak adhesion face 6*a* acts on the weak adhesion face 6*a* as shown in FIG. 12 by the leftward and rightward pulling force acting on the portions e and f of the easy peel tape 4 located below the opening section side edge of the easy peel tape 4 by the distances of the non-adhesion portions G1 and G2 whereby an interface or condensation separation occurs.

On the other hand, the weak adhesion face 6*a* of the easy peel layer 11 is never separated by the pressure from the bag body interior section whereby a state of sealing the bag body is maintained. The reason is that the bag body interior section side end g of the weak adhesion 6*a* and the bag body interior section side end h of the strong adhesion 5 having the width E2 narrower than the tape width with the non-adhesion portion G3 provided between the bag body interior section side edge of the strong adhesion 5 and the lower edge of the easy peel tape 4 have the adhesion width difference of long and short widths.

Namely, when the pressure is applied from the bag body interior section as shown in FIG. 10, the force acts on the bag body interior section side edge g of the weak adhesion 6 on the side of the panel film 1*a* while the force acts on the portion h of the easy peel tape on the interior section side of the strong adhesion 5 having the width E2 narrower than tape width on the side of the panel film 1*b*. The forces applied to the bag body interior section side edge h of the strong adhesion 5 having the adhesion width difference of long and short widths are the forces F2 applied in the surface direction of the strong adhesion 5 and the weak adhesion 6*a*. This force F2 of the surface direction of the weak adhesion face 6*a* never separates the weak adhesion face 6*a* of the easy peel layer 11 whereby the state of sealing the bag body is maintained.

A design of the position of the bag body opening section side edges and the bag body interior section side edges of the weak and strong adhesions 6*a* and 5 may arbitrarily changes as indicated by D1, D2 and D3 of the strong adhesion 5*a* and 5*b* of the embodiment 1. Just one easy peel tape 4 of the embodiment 2 would be able to obtain the function and effect similar to those of the aforementioned embodiment 1 and further a cost reduction.

An adhesion pattern of the weak adhesion 6 and 6*a* of the easy peel tape(s) 4 of the aforementioned embodiments 1 and 2 is illustrated in FIG. 12. Namely, the weak adhesion(s) on the opening section sides of the bag body may be in a serration form 13, a rectangular form 14, a round shaped form 15, a lattice seal form 16, a line seal form 17 and a cellular seal form 18, which may be used selectively.

The invention has such an advantage that complicated steps are not required and the processing is easier in comparison with what is obtained by coating separable adhesive resin directly to the surfaces of the films etc., and therefore the manufacturing cost is cheaper.

The bag of the invention can also be applied not only to a package for liquid or water-like goods, but also to a package for goods such as granular material, particulates or various other materials.

Although, in the aforementioned embodiments, the bags have the re-closable zipper 3 provided above the easy peel tapes 4*a*, 4*b* and 4, the zipper 3 may be provided below the easy peel tapes 4*a*, 4*b* and 4 or the invention may be applied to the bag having no zipper.

POSSIBILITY OF UTILIZATION IN INDUSTRIES

Since the easy peel layer can be separated by the weak force from the side of the opening section of the bag body due to the weak adhesion of the easy peel layer to thereby facilitate the opening operation of the opening section of the bag body while the weak adhesion of the easy peel layer is never separated by the pressure within the interior section of the bag body to thereby maintain the sealing state, the invention has a high utilization in industries.

What is claimed is:

1. A synthetic resin bag having an easy-opening function, said synthetic resin bag comprising two front and back panel films forming a bag body, said panel films having respective grasping pieces provided on the side of opening of said panel films, characterized by comprising two easy peel tapes having the same longitudinal width perpendicular to the lateral width direction of said bag body and disposed inside of said panel films of the bag body in an opening section thereof over the whole lateral widths thereof, said two easy peel tapes each including an easy peel layer and a thermally adhesive layer, said easy peel layers of said two easy peel tapes faced to each other being weakly adhered to each other so that the weak adhesion faces of said easy peel layers of said two easy peel tapes have lower ends disposed at the same level position while said thermally adhesive layers of said two easy peel tapes being strongly adhered to the inner faces of said panel films of said bag body, respectively so that said thermally adhesive layers have an adhesion width difference of long and short widths in a direction perpendicular to said lateral width direction of said bag body, said strong adhesion portions of said thermally adhesive layers being formed so that they have lower ends shifted relative to each other while said thermally adhesive layer of said easy peel tape having the shorter strong adhesion width has a non-adhesion portion whereby said easy peel layers of said two easy peel tapes can be easily separated on the side of said opening section of said bag body by a force acting in a direction opposite to each other when said grasping pieces are pulled in leftward and rightward directions while said easy peel layers of said two easy peel tapes can be prevented from being separated on the side of an interior section of said bag body corresponding to a section inside of said easy peel tape by a force acting in the surface direction of said weak adhesion face by means of said adhesion width difference between strong adhesion faces of said thermally adhesive layers of said easy peel layer when a pressure is applied from the interior section of said bag body.

2. A synthetic resin bag having an easy-opening function as set forth in claim 1, and wherein said strong adhesion face of said thermally adhesive layer of one of said two easy peel tapes has the whole face adhered to the inside faces of said bag body in the longitudinal width direction.

3. A synthetic resin bag having an easy-opening function as set forth in claim 2, and wherein said easy peel tapes further include a middle layer between said thermally adhesive layer and said easy peel layer.

4. A synthetic resin bag having an easy-opening function as set forth in claim 1, and wherein the upper ends of said strong adhesion faces of said thermally adhesive layers of said two easy peel tapes are shifted slightly downward from the upper end of said two easy peel tapes.

5. A synthetic resin bag having an easy-opening function as set forth in claim 4, and wherein said easy peel tapes further include a middle layer between said thermally adhesive layer and said easy peel layer.

6. A synthetic resin bag having an easy-opening function as set forth in claim 1, and wherein the lower end of the wider one of said strong adhesion faces of said thermally adhesive layers of said two each peel tapes is shifted slightly upward from the lower end of the corresponding easy peel tape.

7. A synthetic resin bag having an easy-opening function as set forth in claim 6, and wherein said easy peel tapes further include a middle layer between said thermally adhesive layer and said easy peel layer.

8. A synthetic resin bag having an easy-opening function as set forth in claim 1, and wherein said easy peel tapes further include a middle layer between said thermally adhesive layer and said easy peel layer.

* * * * *